US008301439B2

(12) United States Patent
Kim et al.

(10) Patent No.: US 8,301,439 B2
(45) **Date of Patent: *Oct. 30, 2012**

(54) METHOD AND APPARATUS TO ENCODE/DECODE LOW BIT-RATE AUDIO SIGNAL BY APPROXIMIATING HIGH FREQUENCY ENVELOPE WITH STRONGLY CORRELATED LOW FREQUENCY CODEVECTORS

(75) Inventors: Junghoe Kim, Seoul (KR); Eunmi Oh, Seongnam-si (KR); Boris Kudryashov, St. Petersburg (RU); Konstantin Osipov, St. Petersburg (RU)

(73) Assignee: Samsung Electronics Co., Ltd, Suwon-si (KR)

( * ) Notice: Subject to any disclaimer, the term of this patent is extended or adjusted under 35 U.S.C. 154(b) by 909 days.

This patent is subject to a terminal disclaimer.

(21) Appl. No.: 11/456,946

(22) Filed: Jul. 12, 2006

(65) Prior Publication Data

US 2007/0016411 A1 Jan. 18, 2007

(30) Foreign Application Priority Data

Jul. 15, 2005 (KR) ..... 10-2005-0064508

(51) Int. Cl.
*G10L 21/02* (2006.01)
*G10L 11/06* (2006.01)
*G10L 19/00* (2006.01)

(52) U.S. Cl. ..... 704/226; 704/215; 704/501

(58) Field of Classification Search ..... 704/226, 704/265

See application file for complete search history.

(56) References Cited

U.S. PATENT DOCUMENTS 6,680,972 B1 1/2004 Liljeryd et al.
6,691,092 B1 * 2/2004 Udaya Bhaskar et al. .... 704/265
6,754,624 B2 * 6/2004 Choy et al. ..... 704/233

(Continued)

FOREIGN PATENT DOCUMENTS

CN 1813286 8/2006

(Continued)

OTHER PUBLICATIONS

Korean Search Report dated Oct. 10, 2006 issued in PCT/KR2006/2454.

(Continued)

*Primary Examiner* — Talivaldis Ivars Smits
*Assistant Examiner* — Farzad Kazeminezhad
(74) *Attorney, Agent, or Firm* — Stanzione & Kim, LLP

(57) ABSTRACT

A method of encoding a low bit-rate audio signal includes quantizing and encoding a plurality of low frequency sub-bands of an audio signal in a frequency domain, generating a codebook of codevectors using sub-bands of the audio signal spectrum, detecting an envelope of another frequency sub-band of the audio signal and quantizing and losslessly-encoding the detected envelope, selecting a codevector most similar to the higher frequency sub-band spectrum from the generated codebook's codevectors and determining its codebook codevector index, and generating a bit stream. Decoding the low bit-rate audio signal includes restoring and dividing a bit stream into a plurality of first frequency sub-bands and at least one second frequency sub-band and inversely quantizing the first frequency sub-bands in the bit stream, restoring codebook codevector index information and envelope information for the second frequency sub-band, generating a codebook of codevectors using the inversely quantized first frequency sub-bands, and restoring the second frequency sub-band using the restored codevector index information and the envelope information.

44 Claims, 11 Drawing Sheets

U.S. PATENT DOCUMENTS

| | | | | |
|---|---|---|---|---|
| 7,318,034 | B2 * | 1/2008 | Sato | 704/265 |
| 2007/0052560 | A1 * | 3/2007 | Van Der Veen et al. | 341/51 |
| 2008/0249783 | A1 * | 10/2008 | Stachurski | 704/500 |

FOREIGN PATENT DOCUMENTS

| | | | |
|---|---|---|---|
| EP | 1441330 | A2 | 7/2004 |
| JP | 10-285043 | | 10/1998 |
| JP | 2001-521648 | | 11/2001 |
| JP | 2001-525079 | | 12/2001 |
| JP | 2002-524960 | | 8/2002 |
| JP | 2003-15698 | | 1/2003 |
| KR | 1997-71695 | | 11/1997 |
| KR | 2000-74088 | | 12/2000 |
| WO | 98/52187 | | 11/1998 |
| WO | 98/57436 | | 12/1998 |
| WO | 00/14886 | | 3/2000 |
| WO | 2005/076260 | | 8/2005 |

OTHER PUBLICATIONS

European Patent Search Report issued Dec. 9, 2008 in EP Application No. 06769032.1.

Non-Final Rejection issued by the Japanese Patent Office on Jan. 11, 2011 in JP Application 2008-521299.

Chinese Office Action issued Aug. 11, 2010 in CN Application No. 200680025921.7.

* cited by examiner

METHOD AND APPARATUS TO ENCODE/DECODE LOW BIT-RATE AUDIO SIGNAL BY APPROXIMIATING HIGH FREQUENCY ENVELOPE WITH STRONGLY CORRELATED LOW FREQUENCY CODEVECTORS

CROSS-REFERENCE TO RELATED APPLICATIONS

This application claims the benefit of Korean Patent Application No. 10-2005-0064508, filed on Jul. 15, 2005, in the Korean Intellectual Property Office, the disclosure of which is incorporated herein in its entirety by reference.

BACKGROUND OF THE INVENTION

1. Field of the Invention

The present general inventive concept relates to encoding and decoding of an audio signal, and more particularly, to a method and apparatus to encode/decode a low bit-rate audio signal.

2. Description of the Related Art

In the existing MPEG-4 advanced audio coding (AAC) algorithm, a full-band audio signal is encoded using a quantizing and coding method. However, at a low bit rate, a sub-band audio signal is generally encoded, because the number of available bits is small. In this case, since a bandwidth of the audio signal is reduced, poor sound quality results.

A high frequency component can be encoded only by detecting an envelope of a spectrum rather than a fine structure of the signal. Accordingly, in the MPEG-4 advanced audio coding (AAC) algorithm, a high frequency component having a strong noise component is encoded using a perceptual noise substitution (PNS) tool. For PNS encoding, an encoder detects an envelope of noise from the high frequency component and a decoder inserts random noise into the high frequency component, and restores the high frequency component. The high frequency component including stationary random noise can be efficiently encoded using the PNS tool. However, if the high frequency component includes transient noise and is encoded by the PNS tool, metallic noise or buzz noise occurs.

In an attempt to solve this problem, in the MPEG-4 high efficiency (HE) AAC algorithm, the high frequency component is encoded using a spectral band replication (SBR) tool. Since the SBR tool uses a quadrature mirror filter (QMF), in the core AAC, a modified discrete cosine transform (MDCT) output is subjected to the QMF to obtain the high frequency component. In this case, complexity increases. Furthermore, a low frequency component of a specific band is replicated and is encoded to be similar to an original high frequency signal using envelope/noise floor/time-frequency grid. However, additional information such as the envelope/noise floor/time-frequency grid requires bit rates of several kbps (kilobits per second) and a large amount of calculation.

SUMMARY OF THE INVENTION

The present general inventive concept provides a method and apparatus to encode a low bit-rate audio signal which can efficiently encode a high frequency component, which is perceptually less important, without reducing a frequency bandwidth to compress high sound quality.

The present general inventive concept also provides a method and apparatus to decode a low bit-rate audio signal which can decode a high frequency component, which is perceptually less important, from an encoded bit stream without reducing a frequency bandwidth to compress high sound quality.

Additional aspects of the present general inventive concept will be set forth in part in the description which follows and, in part, will be obvious from the description, or may be learned by practice of the general inventive concept.

The foregoing and/or other aspects of the present general inventive concept are achieved by providing a method of encoding a low bit-rate audio signal, including quantizing and losslessly-encoding a specific frequency component of an audio signal in a frequency domain, generating codebooks using the audio signal in the frequency domain, detecting an envelope of a frequency component of the audio signal other than the specific frequency component in a specific band unit and quantizing and losslessly-encoding the detected envelope of the other frequency component, selecting a codebook most similar to the other frequency component to be encoded from among the generated codebooks and determining a codebook index (fine structure), losslessly-encoding the determined codebook index, and generating a bit stream using the losslessly encoded specific frequency component, the losslessly encoded envelope of the other frequency component, and the losslessly encoded codebook index.

The foregoing and/or other aspects of the present general inventive concept are also achieved by providing a method of encoding a low bit-rate audio signal, including quantizing and losslessly encoding a significant frequency component of an audio signal in a frequency domain, generating codebooks using the audio signal in the frequency domain, detecting an envelope of a frequency component of the audio signal other than the significant frequency component in a specific band unit and quantizing and losslessly encoding the detected envelope of the other frequency component, checking whether a codebook having at least a predetermined similarity exists among the generated codebooks with respect to a high frequency band to be encoded, if a similar codebook exists, selecting the similar codebook, determining a codebook index, and losslessly-encoding the determined codebook index and information indicating that the similar codebook exists, if a similar codebook does not exist, losslessly encoding information indicating that a similar codebook does not exist, and generating a bit stream using the losslessly encoded significant frequency component, the losslessly encoded envelope of the frequency component, and the losslessly encoded codebook index.

The method may further include converting the audio signal in a time domain into the audio signal in the frequency domain.

The foregoing and/or other aspects of the present general inventive concept are also achieved by providing an apparatus to encode a low bit-rate audio signal, including a low frequency quantizing/lossless-encoding unit which quantizes and losslessly-encodes a specific frequency component of an audio signal in a frequency domain, a codebook generating unit which generates codebooks using the audio signal in the frequency domain, an envelope quantizing/lossless-encoding unit which detects an envelope of a frequency component of the audio signal other than the specific frequency component in a specific band unit and quantizes and losslessly-encodes the detected envelope of the other frequency component, a codebook index acquiring unit which selects a codebook most similar to the other frequency component of the audio signal to be encoded from among the generated codebooks and determines a codebook index (fine structure), an index lossless-encoding unit which losslessly-encodes the determined codebook index, and a bit stream generating unit which generates a bit stream using the losslessly encoded specific frequency component, the losslessly encoded envelope of the other frequency component, and the losslessly encoded codebook index.

The foregoing and/or other aspects of the present general inventive concept are also achieved by providing an apparatus to encode a low bit-rate audio signal, including an ISC quantizing/lossless-encoding unit which quantizes and losslessly-encodes a significant frequency component of an audio signal in a frequency domain, a codebook generating unit which generates codebooks using the audio signal in the frequency domain, an envelope quantizing/lossless-encoding unit which detects an envelope of a frequency component of the audio signal other than the significant frequency component in a specific band unit and quantizes and losslessly-encodes the detected envelope of the other frequency component, a similarity checking unit which checks whether a codebook having at least a predetermined similarity exists in the codebooks with respect to a high frequency band to be encoded, a codebook existence information/index encoding unit which, if a similar codebook exists, selects the similar codebook, determines a codebook index, and losslessly-encodes the determined codebook index and information indicating that the similar codebook exists, a codebook existence information encoding unit which, if a similar codebook does not exist, losslessly-encodes information indicating that a similar codebook does not exist, and a bit stream generating unit which generates a bit stream using the losslessly encoded significant frequency component, the losslessly encoded envelope of the other frequency component, and the losslessly encoded codebook index.

The foregoing and/or other aspects of the present general inventive concept are also achieved by providing an encoding apparatus, including a first quantizing/encoding unit to quantize a first frequency component of a full spectrum of an audio signal and to encode the quantized first frequency component, a second quantizing/encoding unit to quantize one or more envelopes of one or more bands of a second frequency component of the full spectrum and to encode the quantized one or more envelopes, a codebook unit to generate one or more codebooks from one or more bands of the first frequency component, to determine whether a similar codebook exists for each of the bands of the second frequency component, and to encode codebook similarity information to indicate similarities between the bands of the second frequency components and the codebooks, and a bit stream unit to generate a bitstream including the encoded first frequency component, the encoded envelopes of the bands of the second frequency components, and the encoded similarity information.

The second quantizing/encoding unit may encode the envelopes of the second frequency component using an adaptive vector quantization when the corresponding bands in the second frequency component are determined to be similar to ones of the codebooks, and may encode the envelopes of the second frequency component using a perceptual noise substitution when the corresponding bands in the second frequency component are determined not to be similar to any of the codebooks.

The foregoing and/or other aspects of the present general inventive concept are also achieved by providing a method of decoding a low bit-rate audio signal, including restoring and dividing a bit stream into a specific frequency component and a frequency component other than the specific frequency component, losslessly decoding and inversely quantizing the specific frequency component, restoring codebook index information and envelope information about the other frequency component, generating codebooks using the specific frequency component which is inversely quantized, and restoring the other frequency component using the restored codebook index information and the restored envelope information about the other frequency component.

The foregoing and/or other aspects of the present general inventive concept are also achieved by providing a method of decoding a low bit-rate audio signal, including restoring and dividing a bit stream into a specific frequency component and a frequency component other than the specific frequency component, losslessly decoding and inversely quantizing the significant frequency component, losslessly decoding information as to whether a similar codebook exists, if a similar codebook exists, restoring codebook index information and envelope information about the other frequency component, generating codebooks using the specific frequency component which is losslessly-decoded and inversely quantized and restoring a high frequency component using the codebook index information and the envelope information about the other frequency component, and if a similar codebook does not exist, restoring the envelope information and restoring the other frequency component using a signal of a previous band and the restored envelope information.

The method may further include converting the audio signal in a time domain into the audio signal in the frequency domain.

The foregoing and/or other aspects of the present general inventive concept are also achieved by providing an apparatus to decode a low bit-rate audio signal, including a bit stream dividing unit which restores and divides a bit stream into a specific frequency component and a frequency component other than the specific frequency component, a low frequency restoring unit which losslessly decodes and inversely quantizes the specific frequency component, a high frequency index/envelope restoring which restores codebook index information and envelope information about the other frequency component, a codebook generating unit which generates codebooks using the specific frequency component inversely quantized in the low frequency restoring unit, and a high frequency restoring unit which restores the other frequency component using the restored codebook index information and the restored envelope information about the other frequency component.

The foregoing and/or other aspects of the present general inventive concept are also achieved by providing an apparatus to decode a low bit-rate audio signal, including a bit stream dividing unit which restores and divides a bit stream into a significant frequency component and a frequency component other than the significant frequency component, a low frequency restoring unit which losslessly decodes and inversely quantizes the significant frequency component, a codebook existence information restoring unit which losslessly-decodes information as to whether a similar codebook exists, an index/envelope restoring unit which, if the similar codebook exists, restores codebook index information and envelope information about the other frequency component, a first high frequency restoring unit which generates codebooks using the significant frequency component which is losslessly decoded and inversely quantized and restores a high frequency component using the restored codebook index information and the restored envelope information about the other frequency component, and a second high frequency restoring unit which, if a similar codebook does not exist, restores the envelope information and restores the other frequency component using a signal of a previous band and the restored envelope information.

The apparatus may further include converting the audio signal in a time domain into the audio signal in the frequency domain.

The foregoing and/or other aspects of the present general inventive concept are also achieved by providing a computer-readable medium having embodied thereon a computer program to execute one or more of the methods described above.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
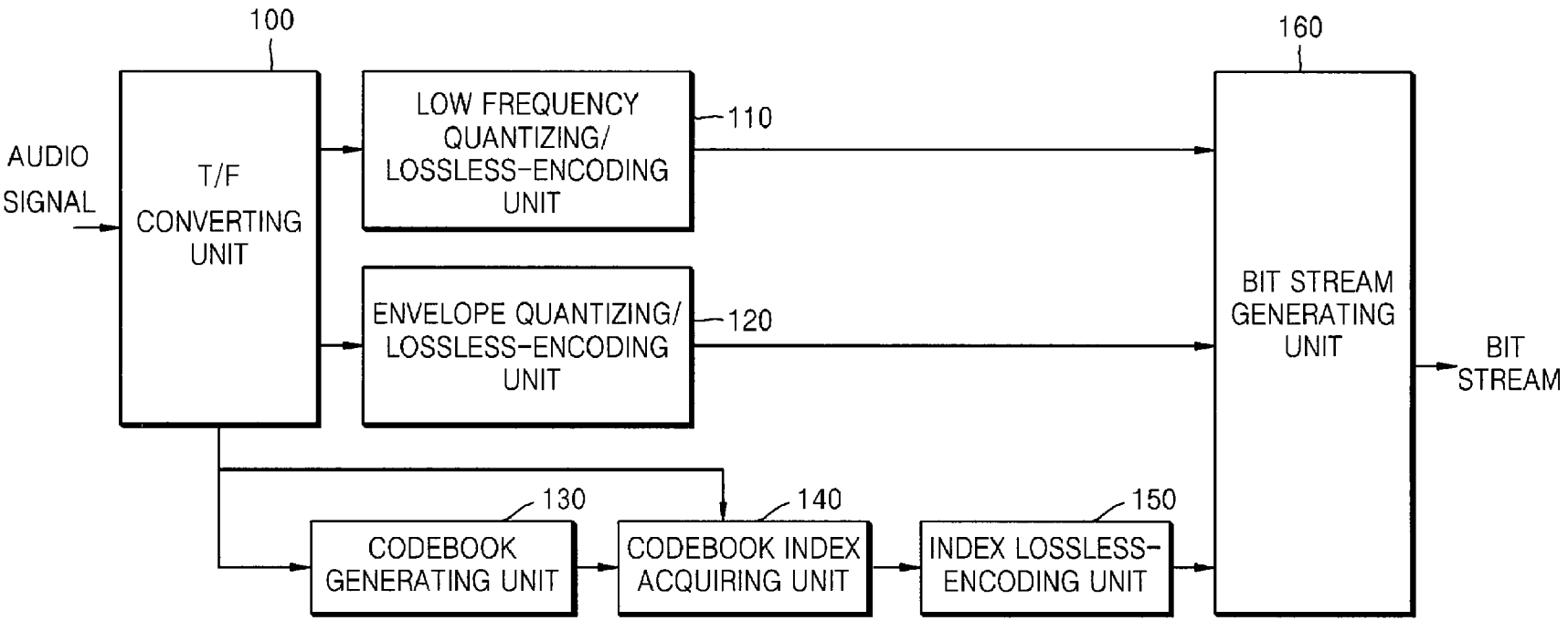
FIG. 1 is a block diagram illustrating a configuration of an apparatus to encode a low bit-rate audio signal according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

According to embodiments of the present general inventive concept, a codebook is generated using a low frequency component of an audio signal, and a high frequency component of the audio signal is efficiently encoded by vector quantization (VQ) using the codebook, without additional information such as envelope/noise floor/time-frequency grid.

FIG. 1 is a block diagram illustrating a configuration of an apparatus to encode a low bit-rate audio signal according to an embodiment of the present general inventive concept. The apparatus in FIG. 1 includes a low frequency quantizing/lossless-encoding unit 110, an envelope quantizing/lossless-encoding unit 120, a codebook generating unit 130, a codebook index acquiring unit 140, an index lossless-encoding unit 150, and a bit stream generating unit 160. The apparatus of the present embodiment may further include a time/frequency (T/F) converting unit 100.

The T/F converting unit 100 converts an audio signal in a time domain into a frequency domain. The conversion is performed using a modified discrete cosine transform (MDCT), a fast Fourier transform (FFT), or a discrete cosine transform (DCT).

The low frequency quantizing/lossless-encoding unit 110 quantizes and losslessly-encodes a specific frequency component (e.g., a low frequency component) of the audio signal in the frequency domain.

The envelope quantizing/lossless-encoding unit 120 detects an envelope from a frequency component other than the specific frequency component in a specific band unit, and quantizes and losslessly-encodes the detected envelope of the other frequency component. The other frequency component may be a high frequency component.

The codebook generating unit 130 generates codebooks using the audio signal in the frequency domain. The high frequency component is divided into sub-bands by a bark band as expressed by Equation 1.

$$f_b = \begin{cases} f/100, & f < 500\,\text{Hz} \\ 9 + 4\log_2(f/1000), & \text{otherwise} \end{cases} \qquad \text{Equation 1}$$

The codebook index acquiring unit 140 selects a codebook most similar to the other frequency component (i.e., the high frequency component) to be encoded from the generated codebooks and determines a code index (fine structure).

The index lossless-encoding unit 150 losslessly-encodes the determined code index.

The bit stream generating unit 160 generates a bit stream using losslessly-encoded data generated by the low frequency quantizing/lossless-encoding unit 110 and the losslessly encoded data generated by the envelope quantizing/lossless-encoding unit 120 and the index lossless-encoding unit 150.

The specific frequency component may be an important spectral component (ISC) having a large amount of information in the audio signal. The quantization and the lossless-encoding of the low frequency quantizing/lossless-encoding unit 110 may be performed by an existing audio encoder and may be MPEG-1 Layer 3(mp3) or MPEG-2/4 AAC.

Figure 2:
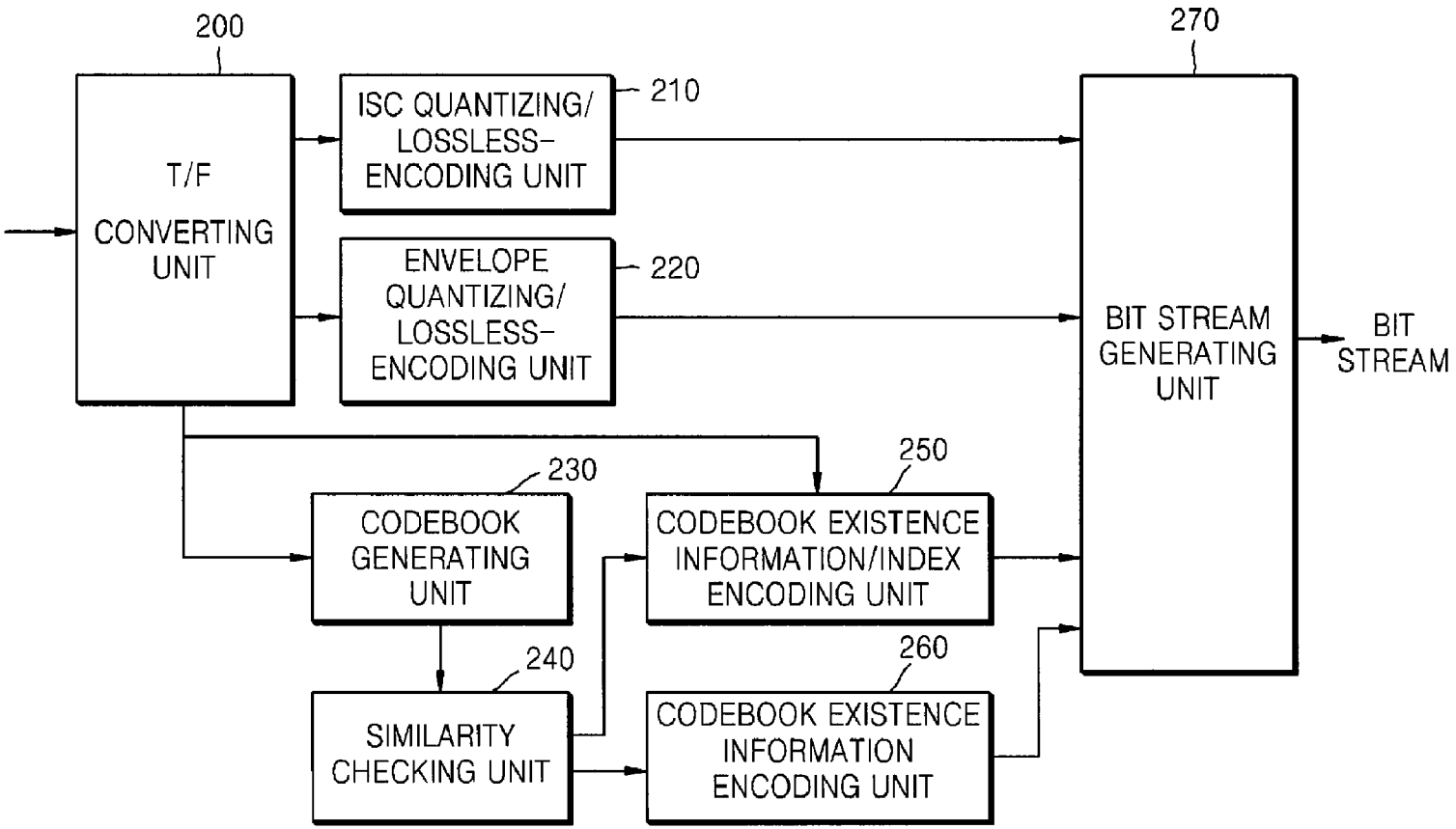
FIG. 2 is a block diagram illustrating a configuration of an apparatus to encode a low bit-rate audio signal according to another embodiment of the present general inventive concept.

FIG. 2 is a block diagram illustrating a configuration of an apparatus to encode a low bit-rate audio signal according to another embodiment of the present general inventive concept. The apparatus in FIG. 2 includes an ISC quantizing/lossless-encoding unit 210, an envelope quantizing/lossless-encoding unit 220, a codebook generating unit 230, a similarity checking unit 240, a codebook existence information/index encoding unit 250, a codebook existence information encoding unit 260, and a bit stream generating unit 270. The apparatus of the present embodiment may further include a T/F converting unit 200.

The T/F converting unit 200 converts an audio signal in a time domain into a frequency domain. The conversion is performed using a modified discrete cosine transform (MDCT), a fast Fourier transform (FFT), or a discrete cosine transform (DCT), similar to the T/F converting unit 100 of FIG. 1.

The ISC quantizing/lossless-encoding unit 210 quantizes and losslessly-encodes an important spectral component (ISC) of a full-band of the audio signal in the frequency domain.

The codebook generating unit 230 generates codebooks using the audio signal in the frequency domain. A high frequency component is divided into sub-bands by a bark band as expressed by Equation 1.

The envelope quantizing/lossless-encoding unit 220 detects an envelope from a frequency component other than the important spectral component (i.e., a significant frequency component) in a specific band unit, and quantizes and losslessly-encodes the detected envelope of the other frequency component. The significant frequency component may be a low frequency component, and the other frequency component may be the high frequency component.

The similarity checking unit 240 checks whether a codebook having at least a predetermined similarity with respect to the high frequency component to be encoded exists in the codebooks. The similarity is measured using a Euclidean distance or a correlation between the codebooks. For example, if 16 codebooks exist based on similarity measurement criteria, a codebook that is most similar is selected from among the 16 codebooks and is encoded by 4 bits. The Euclidean distance or the correlation is calculated using Equation 2, where "CB" refers to a codebook.

Equation 2

$$d_{L2} = \sqrt{\sum (CB_1 - CB_2)^2} \qquad \text{Equation 2}$$

$$d_{cor} = \frac{\sum CB_1 \cdot CB_2}{\sqrt{\sum CB_1^2}\sqrt{\sum CB_1^2}}$$

Next, a power ratio of the high frequency component and the codebook is calculated. Power is calculated using a root mean square (RMS), and the power ratio is quantized and encoded in the dB unit. For example, the power ratio may be quantized in the dB unit and encoded by 5 bits. The power ratio is calculated using Equation 3.

$$power_{low} = \sqrt{\sum_{spectralline(low)} codebook(index)_i * codebook(index)_i} \qquad \text{Equation 3}$$

$$power_{high} = \sqrt{\sum_{spectralline(high)} spectrum_i * spectrum_i}$$

-continued $$\text{power_ratio} = C\log\frac{power_{low}}{power_{high}}$$

$$c = scalingfactor$$

In a final encoding operation, a codebook index and the power ratio are stored. When it is determined that a similar codebook exists, the codebook existence information/index encoding unit 250 selects the similar codebook, determines a codebook index using the similar codebook, and losslessly-encodes the determined codebook index and information indicating that the similar codebook exists.

When it is determined that a similar codebook does not exist, the codebook existence information encoding unit 260 losslessly-encodes information indicating that the similar codebook does not exist.

The bit stream generating unit 270 generates a bit stream using losslessly-encoded data generated by the ISC quantizing/lossless-encoding unit 210 and losslessly encoded data generated by the envelope quantizing/lossless-encoding unit 220, the codebook existence information/index encoding unit 250, and the codebook existence information encoding unit 260.

The significant frequency component is mainly a low frequency component in a low frequency band. The band may be a bark band that takes hearing characteristics into consideration. The codebook may be generated using overlapped spectra. The similarity may be determined using the Euclidean distance or the correlation between the codebooks.

Figure 3:
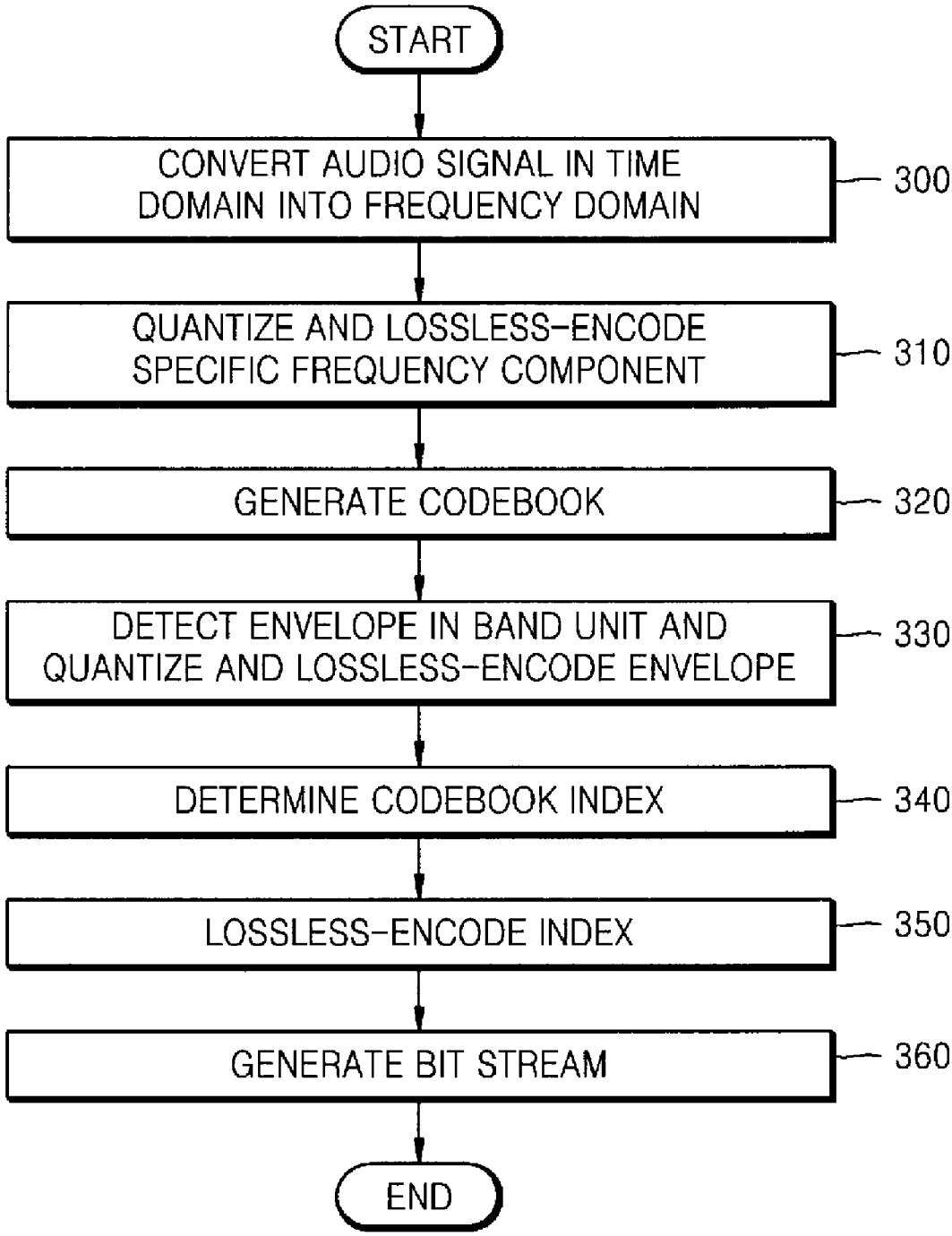
FIG. 3 is a flowchart illustrating a method of encoding a low bit-rate audio signal according to an embodiment of the present general inventive concept.

FIG. 3 is a flowchart illustrating a method of encoding a low bit-rate audio signal according to an embodiment of the present general inventive concept, which may be performed by the apparatus of FIG. 1.

First, when an audio signal is input, the T/F converting unit 100 converts the audio signal in a time domain into a frequency domain (operation 300). Then, the low frequency quantizing/lossless-encoding unit 110 encodes a specific frequency component (i.e., a low frequency component (4 to 6 KHz)) of the audio signal in the frequency domain using a quantizing and coding method, such as MPEG-4 AAC (operation 310).

The codebook generating unit 130 generates codebooks using the audio signal in the frequency domain (operation 320). A high frequency component is divided into sub-bands by a bark band as expressed by Equation 1. If the high frequency component has a 2048 frame length, the sub-bands are defined by Table 1.

TABLE 1

| | Index band | | | | | | | | |
|---|---|---|---|---|---|---|---|---|---|
| | 0 | 1 | 2 | 3 | 4 | 5 | 6 | 7 | 8 |
| Sample | 0 | 9 | 18 | 27 | 37 | 46 | 55 | 65 | 78 |
| Frequency, Hz | 0 | 107 | 204 | 301 | 409 | 506 | 602 | 710 | 850 |
| | Index band | | | | | | | | |
| | 9 | 10 | 11 | 12 | 13 | 14 | 15 | 16 | 17 |
| Sample | 92 | 110 | 131 | 156 | 185 | 220 | 262 | 312 | 371 |
| Frequency, Hz | 1001 | 1195 | 1421 | 1690 | 2002 | 2379 | 2831 | 3369 | 4005 |

TABLE 1-continued

| | Index band | | | | | | | | |
|---|---|---|---|---|---|---|---|---|---|
| | 18 | 19 | 20 | 21 | 22 | 23 | 24 | 25 | 26 |
| Sample | 441 | 525 | 624 | 743 | 883 | 1050 | 1249 | 1486 | 1763 |
| Frequency, Hz | 4758 | 5663 | 6729 | 8010 | 9517 | 11315 | 13458 | 16009 | 19035 |

If a $20^{th}$ band is an index to distinguish (i.e., separate) the low frequency signal and the high frequency signal, the $20^{th}$ band covers up to about 6 kHz, a band before the $20^{th}$ band is already losslessly encoded by the low-frequency quantizing/lossless encoding unit 110, and a band after the $20^{th}$ band is encoded by adaptive vector quantization (AVQ). The $20^{th}$ band is composed of 119 spectral lines. In order to represent the 119 spectral lines, codebooks are generated using the low frequency component. Since a number of the samples in the band before the $20^{th}$ band is 624, overlapped codebooks are encoded in order to represent the 119 spectral lines. A number of the codebooks is represented by a power of 2, for example, 16. Accordingly, 119 (by dividing 624 by 16) overlapped uniform codebooks are generated.

The envelope quantizing/lossless-encoding unit 120 detects an envelope from the frequency component other than the specific frequency component (for example, the high frequency component in a specific band unit), and quantizes and losslessly-encodes the envelope (operation 330).

The codebook index acquiring unit 140 selects a codebook that is most similar to the other frequency band (without the specific frequency component) to be encoded from the code books and determines a code index (fine structure) (operation 340). The index lossless-encoding unit 150 losslessly-encodes the code index (operation 350). The bit stream generating unit 160 generates a bit stream using the losslessly-encoded data generated in the operation 310 and the losslessly-encoded data generated in the operations 320 and 350 (operation 360). The specific frequency component may be an important spectral component (ISC) having a large amount of information in the audio signal (that is, the low frequency component). The quantization and the lossless encoding may be mp3 or AAC.

Figure 4:
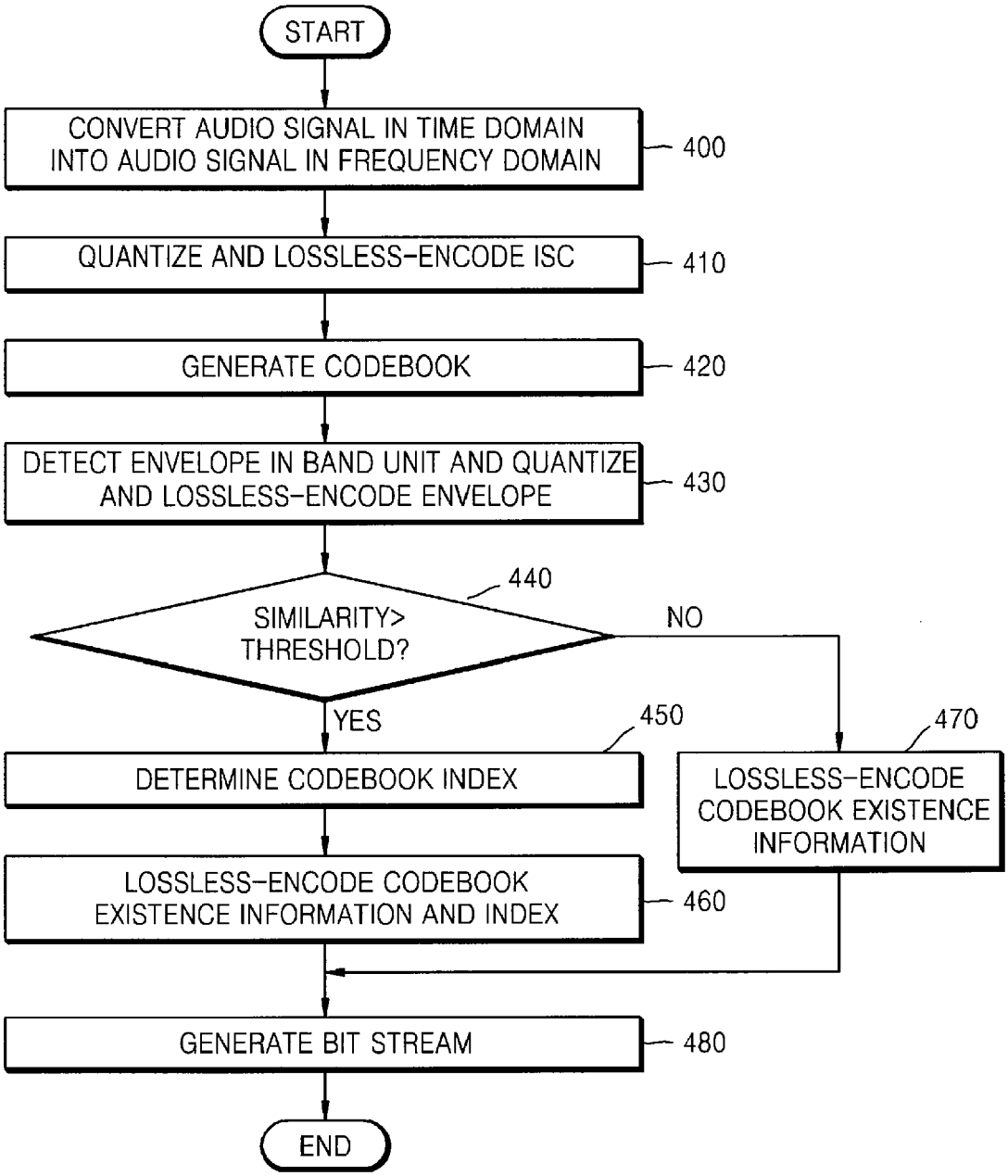
FIG. 4 is a flowchart illustrating a method of encoding a low bit-rate audio signal according to another embodiment of the present general inventive concept.

FIG. 4 is a flowchart illustrating a method of encoding a low bit-rate audio signal according to another embodiment of the present general inventive concept, which may be performed by the apparatus of FIG. 2. First, when an audio signal is input, the T/F converting unit 200 converts the audio signal in a time domain into a frequency domain (operation 400). An important spectral component (ISC) of the audio signal in the frequency domain (for example, a low frequency component) is then encoded using a quantizing and coding method, such as MPEG-4 AAC. The ISC may be a significant frequency component. That is, the ISC quantizing/lossless-encoding unit 210 quantizes and losslessly-encodes the ISC of the audio signal in the frequency domain (operation 410).

The codebook generating unit 230 generates codebooks using the audio signal in the frequency domain (operation 420). The frequency component other than the significant frequency component (for example, a high frequency component), is divided into sub-bands by a non-uniform band that takes hearing characteristics into consideration expressed by Equation 1, for example, the bark band. If the high frequency component has a 2048 frame length, the sub-bands are defined by Table 1.

In Table 1, if a $20^{th}$ band is an index to distinguish (i.e., separate) the low frequency signal and the high frequency signal, the $20^{th}$ band covers up to about 6 kHz, a band before the $20^{th}$ band is already losslessly encoded by the ISC-quantizing/lossless encoding unit 210, and a band after the $20^{th}$ band is encoded by adaptive vector quantization (AVQ), which will be described infra with reference to FIG. 5. The $20^{th}$ band is composed of 119 spectral lines. In order to represent the 119 spectral lines, codebooks are generated using the low frequency component. Since the number of the samples before the $20^{th}$ band is 624, overlapped codebooks are encoded in order to represent the 119 spectral lines. A number of the codebooks is represented by a power of 2, for example, 16. Accordingly, 119 overlapped uniform codebooks are generated.

The envelope quantizing/lossless-encoding unit 220 detects an envelope from the high frequency component in a specific band unit, and quantizes and losslessly-encodes the detected envelope (operation 430).

The similarity checking unit 240 checks whether a codebook having at least a predetermined similarity exists among the codebooks with respect to the high frequency component to be encoded (operation 440). The similarity is measured using a Euclidean distance or a correlation between the codebooks. For example, if 16 codebooks exist based on similarity measurement criteria, a codebook that is most similar is selected and is encoded by 4 bits. The Euclidean distance or the correlation is calculated using Equation 2.

The power ratio of the high frequency component and the codebook is calculated. The power is calculated using root mean square (RMS) and the power ratio is quantized and encoded in the dB unit. For example, the power ratio may be quantized in the dB unit and encoded by 5 bits. The power ratio is calculated using Equation 3. In a final encoding operation, the codebook index and the power ratio are stored.

When it is determined that a similar codebook exists, the similar codebook is selected and a codebook index is determined (operation 450). Accordingly, the determined codebook index and information indicating that the similar codebook exists are losslessly-encoded (operation 460). When it is determined that a similar codebook does not exist, the codebook existence information encoding unit 260 losslessly-encodes information indicating that a similar codebook does not exist (operation 470).

Figure 5:
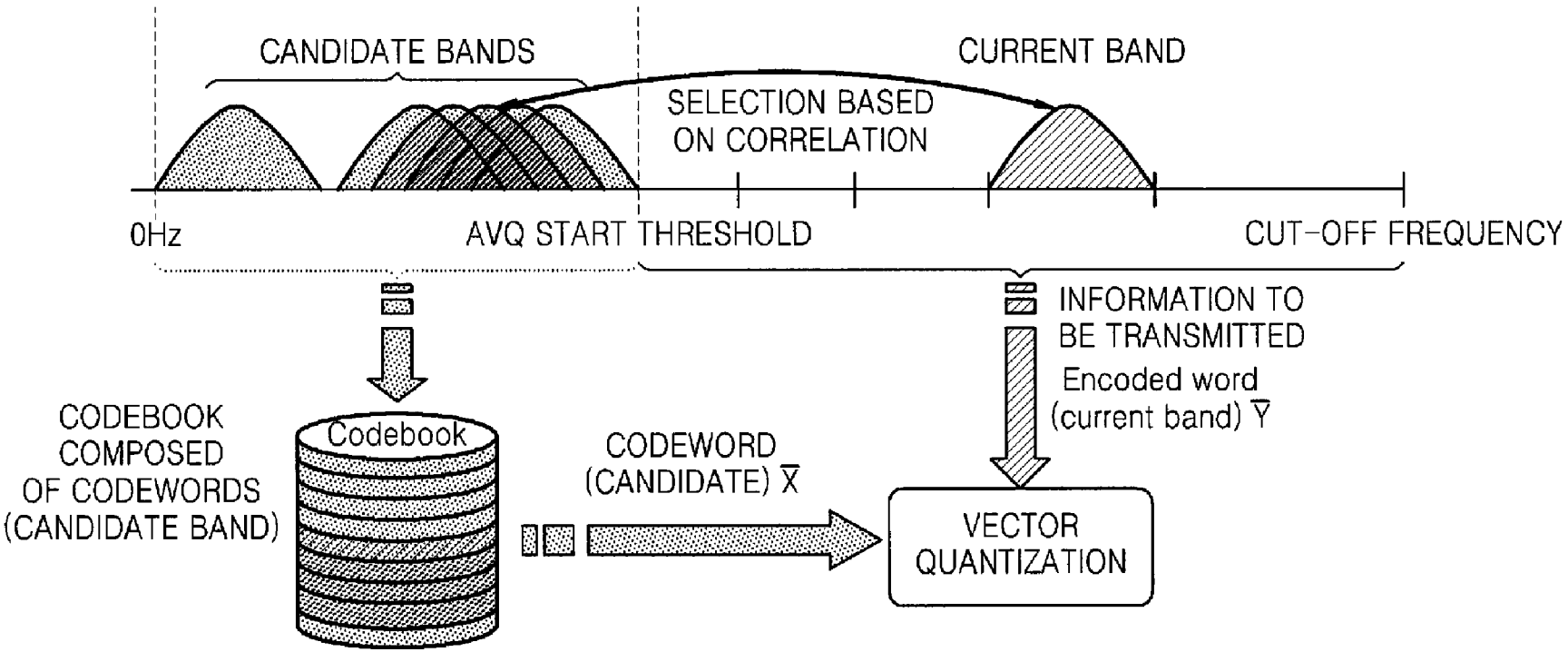
FIG. 5 illustrates a concept of adaptive vector quantization (AVQ)

FIG. 5 illustrates the concept of adaptive vector quantization (AVQ). AVQ will now be described in detail while referring to FIG. 5. The overlapped uniform codebook(s) is generated from the defined sub-band(s) (i.e., candidate bands illustrated in FIG. 5). That is, the codebook is generated from a low frequency signal of the low frequency component using the bark band. The similarity between the generated codebook and a high frequency band of the high frequency component (i.e., a current band) to be encoded is calculated using, for example, a correlation to find a codebook index that is most similar. Next, an energy of the high frequency band is obtained. An energy of the selected codebook is obtained. The ratio of the energies is obtained, converted into the dB unit, and quantized. The codebook index and a quantized energy ratio are stored in the bitstream.

Figure 6:
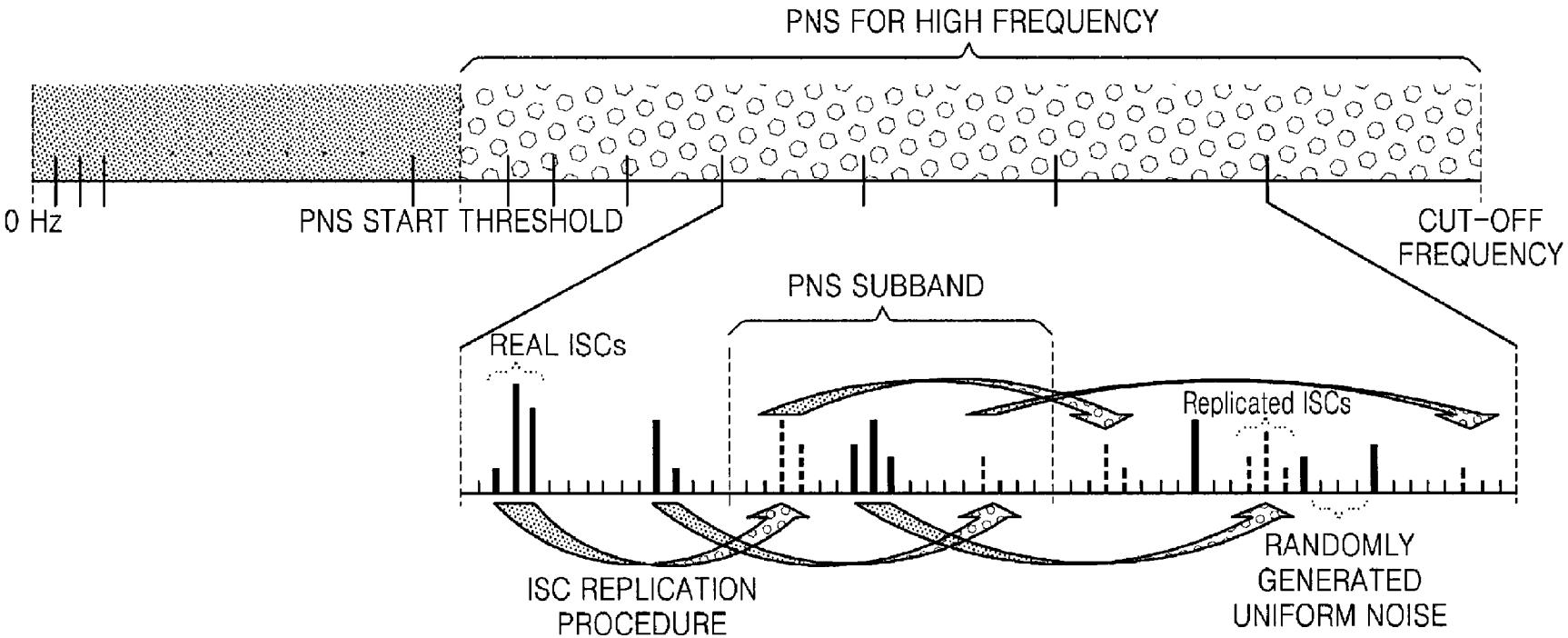
FIG. 6 illustrates a method of generating noise of a high frequency component in perceptual noise substitution (PNS)

The AVQ can be performed when the similarity of the current band (i.e., the current high frequency band) with the low frequency signal is high. If the similarity is low, the high frequency component is encoded by perceptual noise substitution (PNS). FIG. 6 illustrates a method of generating noise of the high frequency component in the PNS. As illustrated in FIG. 6, an encoded noise component in a previous band is replicated to a current band and decoded in correspondence with the envelope. The encoder stores only envelope information in the bit stream. This method removes modulated noise when the low frequency signal and a high frequency signal are not similar to each other due to the AVQ.

Figure 7:
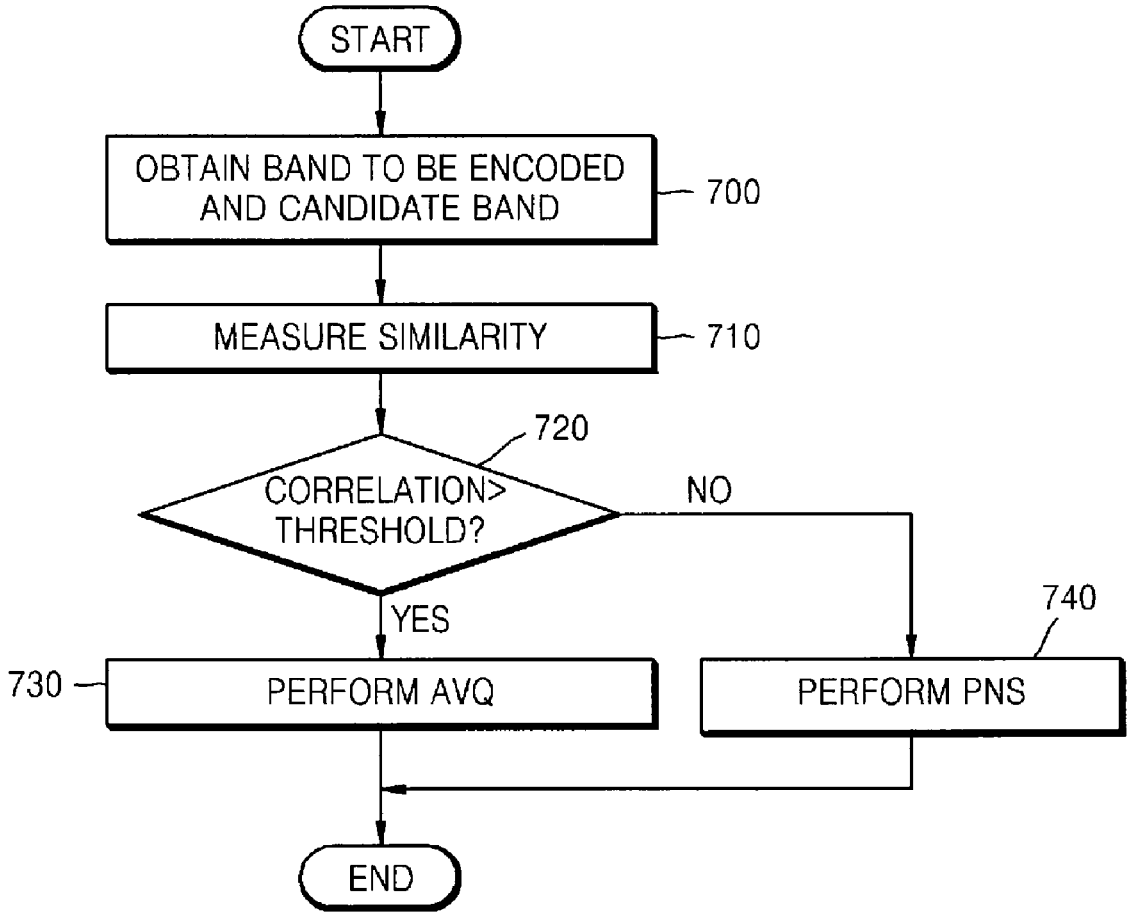
FIG. 7 is a flowchart illustrating a method of selecting one of an AVQ mode and a PNS mode.

FIG. 7 is a flowchart illustrating a method of selecting one of an AVQ mode and a PNS mode. First, a band to be encoded (i.e., the current band) and a candidate band are obtained (operation 700). A similarity based on a correlation between the candidate band and the current band to be encoded is measured (operation 710). The correlation is compared with a predetermined threshold (operation 720). Here, the similarity may be obtained using the Euclidean distance. When a smallest similarity of the codebook is less than the predetermined threshold, it is determined that the similarity is low and thus the perceptual noise substitution (PNS) is performed (operation 730). Otherwise, the vector quantization AVQ is performed (operation 740). In other words, as illustrated in FIG. 5, when the candidate band of the codebook that is least similar to the current band has a corresponding similarity that is less than the predetermined threshold, it is determined that the high frequency component is not similar to the low frequency component and PNS is performed. Different bands in the high frequency component can be encoded using AVQ or PNS depending on respective similarities to the codebooks.

The information stored in the bit stream is as follows:

VQ-availability flag (1 bit)
If (VQ-availability flag==true)
Codebook sub-band number (4 bit)
Amplify coefficient (5 bit)
else
noise envelope (5 bit)

The bit stream generating unit 270 generates a bit stream using the losslessly-encoded data generated in the operation 410 and the losslessly encoded data generated in the operations 430, 460 and 470 (operation 480).

Figure 8:
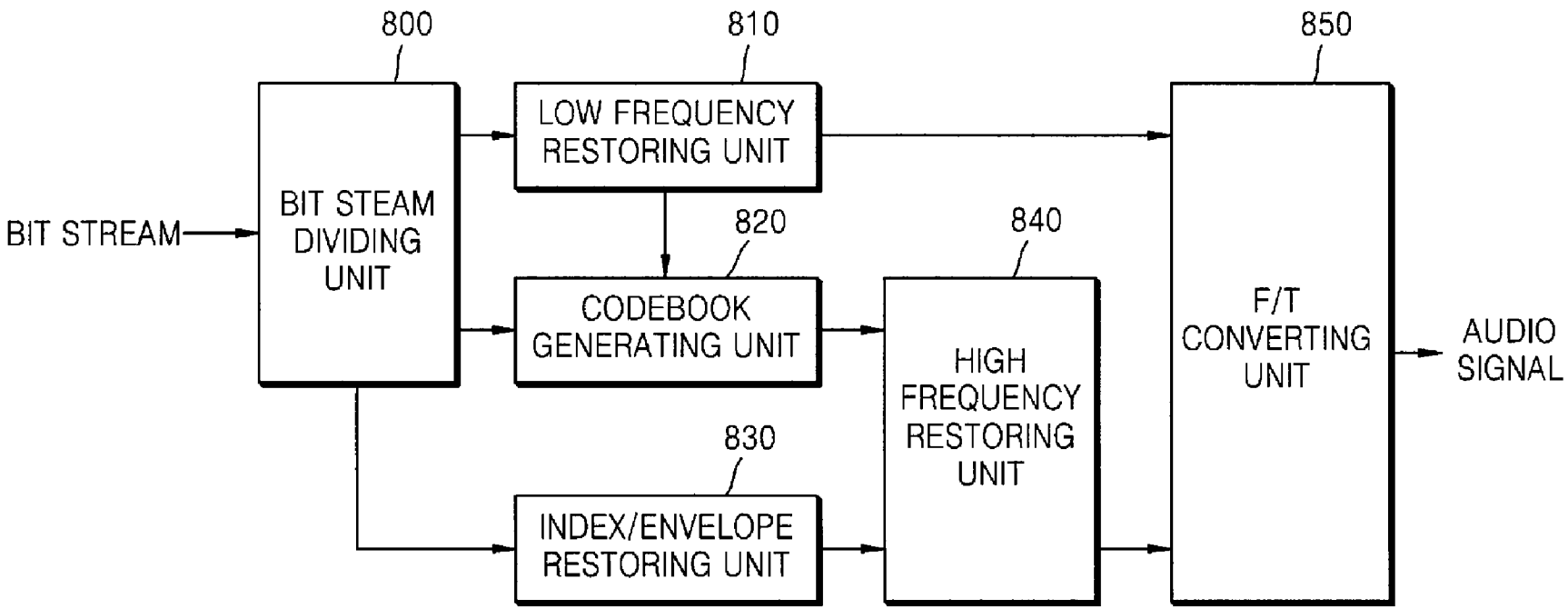
FIG. 8 is a block diagram illustrating a configuration of an apparatus to decode a low bit-rate audio signal according to an embodiment of the present general inventive concept.

Next, apparatuses and methods of decoding a low bit-rate audio signal according to embodiments of the present general inventive concept will be described. FIG. 8 is a block diagram illustrating a configuration of an apparatus to decode a low bit-rate audio signal according to an embodiment of the present general inventive concept. The apparatus in FIG. 8 includes a bit stream dividing unit 800, a low frequency restoring unit 810, a codebook generating unit 820, an index/envelope restoring unit 830, and a high frequency restoring unit 840. The apparatus of the present embodiment may further include an F/T converting unit 850.

The bit stream dividing unit 800 restores and divides a bit stream into a specific frequency component and a frequency component other than the specific frequency component. The specific frequency component may be an important spectral component (ISC).

The low frequency restoring unit 810 decodes and inversely quantizes the specific frequency component. The specific frequency component may be a low frequency component. The codebook generating unit 820 generates codebooks using the specific frequency component, which is inversely quantized in the low frequency restoring unit 810. The index/envelope restoring unit 830 restores codebook index information and envelope information about the frequency (component other than the specific frequency component). The frequency component other than the specific frequency component may be a high frequency component. The high frequency restoring unit 840 restores the frequency component other than the specific frequency component (i.e., the high frequency component) using the restored codebook index information and the restored envelope information.

The inverse F/T converting unit 850 inversely converts (e.g., by inverse MDCT, inverse FFT, or inverse DCT) the audio signal in the frequency domain into the audio signal in the time domain.

Figure 9:
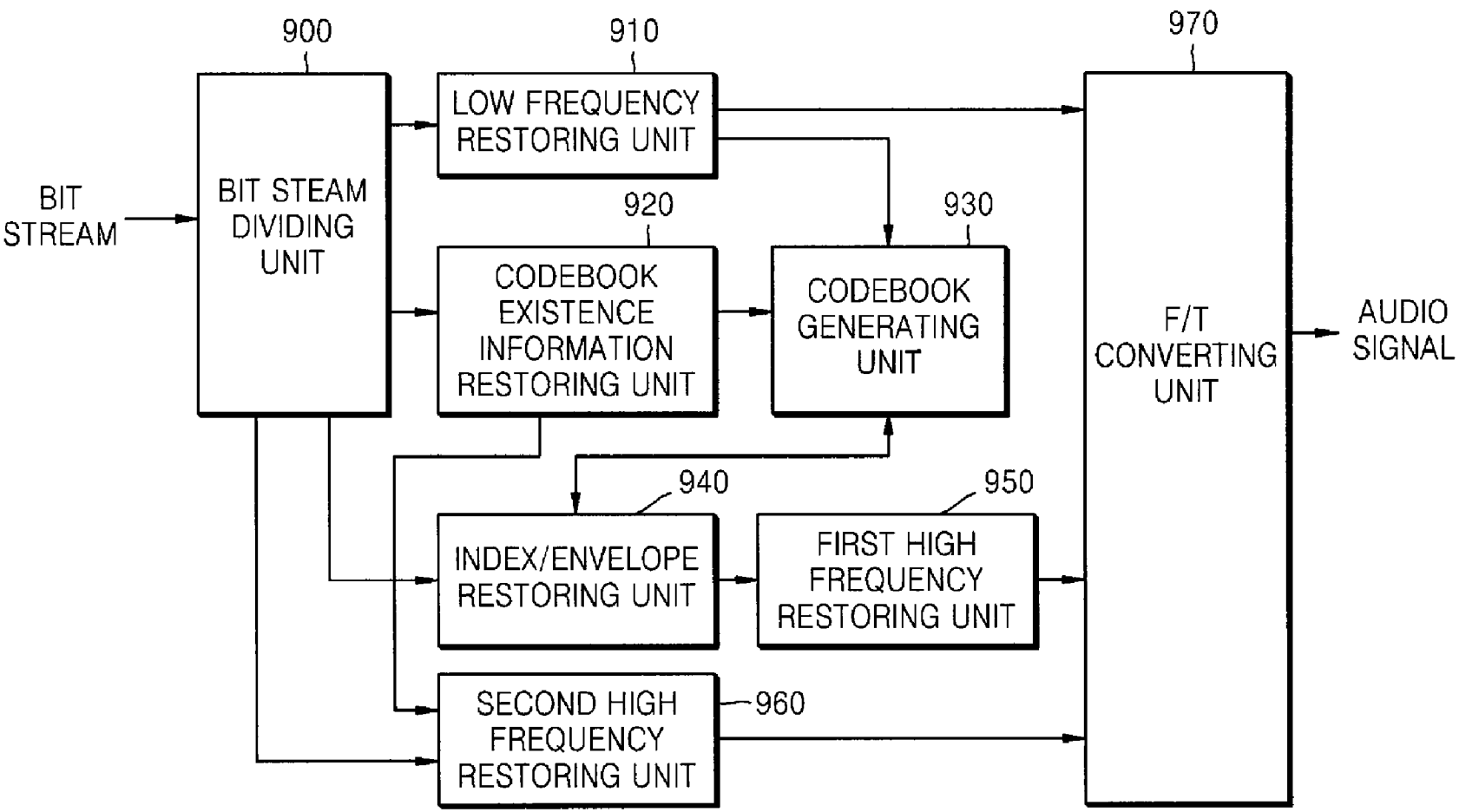
FIG. 9 is a block diagram illustrating a configuration of an apparatus to decode a low bit-rate audio signal according to another embodiment of the present general inventive concept.

FIG. 9 is a block diagram illustrating a configuration of an apparatus to decode a low bit-rate audio signal according to another embodiment of the present general inventive concept. The apparatus in FIG. 9 includes a bit stream dividing unit 900, a low frequency restoring unit 910, a codebook existence information restoring unit 920, a codebook generating unit 930, an index/envelope restoring unit 940, a first high frequency restoring unit 950, and a second high frequency restoring unit 960. The apparatus of the present general inventive concept may further include an F/T converting unit 970.

The bit stream dividing unit 900 restores and divides a bit stream into an important spectral component (ISC) and a frequency component other than the important spectral component. The ISC may be a low frequency component, and the frequency component other than the ISC may be a high frequency component.

The low frequency restoring unit 910 decodes and inversely quantizes the important spectral component (i.e., a significant frequency component). The codebook existence information restoring unit 920 losslessly decodes information as to whether a similar codebook exists. If it is determined that a similar codebook exists, the index/envelope restoring unit 940 restores index information and envelope information about the other frequency component (i.e., the high frequency component). The codebook generating unit 930 generates codebooks using the significant frequency component, which is losslessly-decoded and inversely quantized. The first high frequency restoring unit 950 restores the other frequency component (i.e., the high frequency component) using the restored codebook index information and the restored envelope information. If it is determined that a similar codebook does not exist, the second high frequency restoring unit 960 restores envelope information and restores the other frequency component (i.e., the high frequency component) using a signal of a previous band and the envelope information.

The inverse F/T converting unit 970 inversely converts (e.g., by inverse MDCT, inverse FFT, or inverse DCT) the audio signal in the frequency domain into the audio signal in the time domain. The band may be the bark band, which takes the hearing characteristics into consideration, and the codebooks may be generated by overlapped spectra. Furthermore, the similarity may be determined using the Euclidian distance or correlation between the codebooks.

Figure 10:
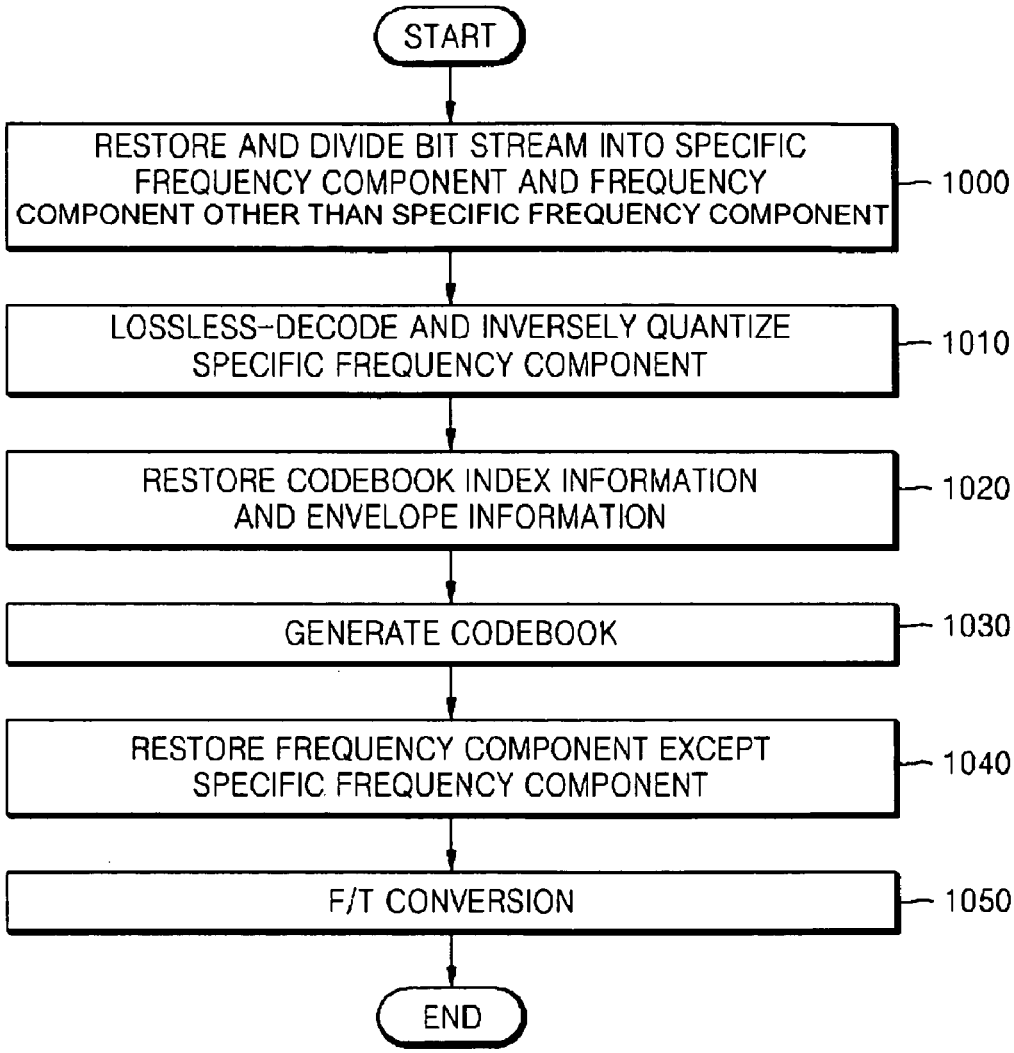
FIG. 10 is a flowchart illustrating a method of decoding a low bit-rate audio signal according to an embodiment of the present general inventive concept.

FIG. 10 is a flowchart illustrating a method of decoding a low bit-rate audio signal according to an embodiment of the present general inventive concept, which may be performed using the apparatus of FIG. 8. First, the bit stream dividing unit 800 restores and divides a bit stream into a specific frequency component and a frequency component other than the specific frequency component (operation 1000). The specific frequency component may be an important spectral component (ISC). The specific frequency component and ISC may be a low frequency component, and the other frequency component may be a high frequency component. The quantizing and lossless-decoding of operation 1000 may be mp3 or AAC. The low frequency restoring unit 810 decodes and inversely quantizes the specific frequency component (operation 1010). The index/envelope restoring unit 830 restores codebook index information and envelope information about the other frequency component (operation 1020). The codebook generating unit 820 generates codebooks using the specific frequency component, which is inversely quantized in operation 1010 (operation 1030). The high frequency restoring unit 840 restores the frequency component other than the specific frequency component using the restored codebook index information and the restored envelope information about the other frequency component (operation 1040).

The inverse F/T converting unit 850 inversely converts (e.g., by inverse MDCT, inverse FFT, or inverse DCT) the audio signal in the frequency domain into the audio signal in the time domain (operation 1050).

Figure 11:
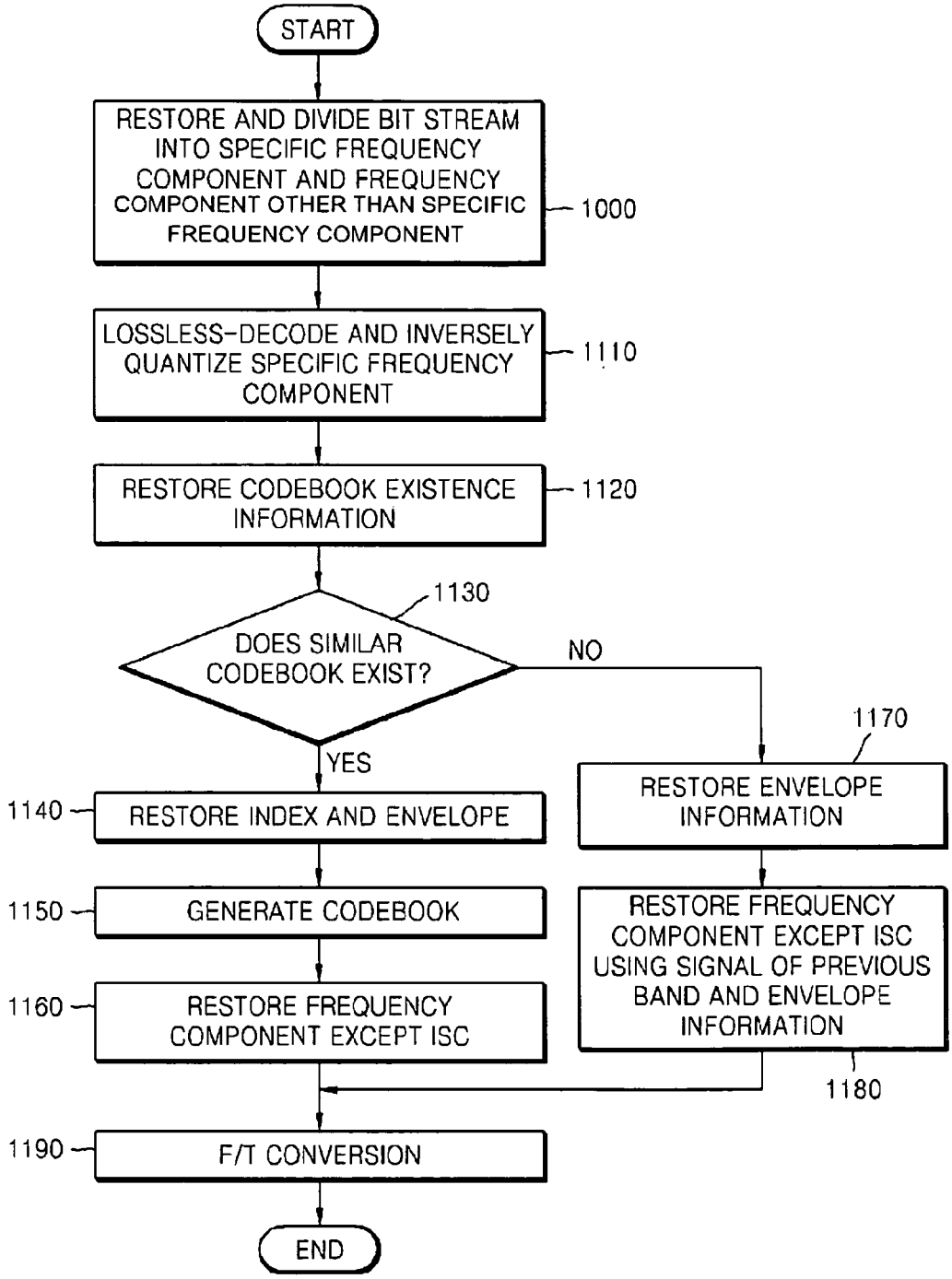
FIG. 11 is a flowchart illustrating a method of decoding a low bit-rate audio signal according to another embodiment of the present general inventive concept.

FIG. 11 is a flowchart illustrating a method of decoding a low bit-rate audio signal according to another embodiment of the present general inventive concept, which may be performed using the apparatus of FIG. 9. The bit stream dividing unit 900 restores and divides a bit stream into an important spectral component (ISC) and a frequency component other than the ISC (operation 1100). The ISC may also be a significant frequency component. The low frequency restoring unit 910 decodes and inversely quantizes the significant frequency component (operation 1110). The significant frequency component may be a low frequency component, and the other frequency component may be a high frequency component.

The codebook existence information restoring unit 920 losslessly-decodes information as to whether a similar codebook exists (operation 1120). It is determined whether a similar codebook exists (operation 1130). If it is determined that the similar codebook exists, the index/envelope restoring unit 940 restores index information and envelope information about the other frequency component (i.e., the high frequency component) (operation 1140). The codebook generating unit 930 generates codebooks using the significant frequency component, which is losslessly decoded and inversely quantized (operation 1150). The first high frequency restoring unit 950 restores the other frequency component (i.e., the high frequency component) using the restored codebook index information and the restored envelope information about the high frequency component (operation 1160).

If it is determined that a similar codebook does not exist (operation 1130), the second high frequency restoring unit 960 restores the envelope information about the high frequency component (operation 1170) and restores the frequency component (i.e., the high frequency component) other than the significant frequency component using a signal of the previous band and the restored envelope information about the high frequency component (operation 1180). The inverse F/T converting unit 970 inversely converts (e.g., by inverse MDCT, inverse FFT, or inverse DCT) the audio signal in the frequency domain into the audio signal in the time domain (operation 1190).

The band may be the bark band that represents a critical bandwidth, which takes the hearing characteristics of the human ear into consideration, and the codebooks may be generated by overlapped spectra. Furthermore, the similarity may be determined using the Euclidian distance or correlation between the codebooks.

The general inventive concept can also be embodied as computer readable codes on a computer readable recording medium. The computer readable recording medium may be any data storage device that can store data which can be thereafter read by a computer system. Examples of the computer readable recording medium include read-only memory (ROM), random-access memory (RAM), CD-ROMs, magnetic tapes, floppy disks, and optical data storage devices.

According to embodiments of the present general inventive concept, it is possible to efficiently encode a high frequency component at a low bit rate. Furthermore, since vector quantization (VQ) is performed based on similarity, it is possible to increase stability of sound quality in a transient/pitched signal.

Accordingly, it is also possible to provide high sound quality while encoding a low bit-rate audio signal without reducing a frequency bandwidth.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A method of encoding a low bit-rate audio signal, the method comprising:

quantizing and encoding a plurality of first frequency sub-bands in a low frequency region of a full-band audio signal having a plurality of frequency sub-bands;

generating a codebook of codevectors using one or more of the plurality of overlapping first frequency sub-bands of the low frequency region of the full-band audio signal to vector quantize at least one high frequency sub-band or to encode at least one high frequency sub-band by perceptual noise substitution;

detecting an envelope of at least one second frequency sub-band in a high frequency region of the full-band audio signal higher than the highest low frequency sub-band and quantizing and encoding the envelope;

selecting a codevector in the first frequency sub-band codebook that is most similar to the second frequency sub-band to be encoded from the generated codebook's codevectors and determining a codebook codevector index which defines a fine structure of the first frequency sub-band to help encode the structure of the similar second frequency sub-band; and generating a bit stream using encoded data generated in the encoding of the first frequency sub-band, the envelope, and the determined codebook codevector index.

2. The method of claim 1, wherein the quantizing and encoding of the first frequency sub-band is one of an MPEG1 layer 3 coding (mp3) and an MPEG-2/4 advanced audio coding (AAC).

3. A method of encoding a low bit-rate audio signal, the method comprising:

quantizing and encoding a plurality of first frequency sub-bands in a low frequency region of a full-band audio signal having a plurality of frequency sub-bands;

generating a codebook of codevectors using one or more of the plurality of first frequency sub-bands of the low frequency region of the full band audio signal to vector quantize at least one high-frequency sub-band or to encode at least one high frequency sub-band by perceptual noise substitution;

detecting an envelope of a second frequency sub-band in the high frequency region of the full-band audio signal higher than the highest low frequency sub-band and quantizing and encoding the detected envelope of the second frequency sub-band;

checking whether a codevector having at least a predetermined similarity exists among the generated codevectors of the codebook with respect to a high frequency band to be encoded;

if the similar codevector exists, selecting the similar codevector, determining a codebook codevector index which defines a fine structure of the first frequency sub-band to help encode the structure of the similar second frequency sub-band;

if a similar codevector does not exist, encoding information indicating that a similar codevector does not exist; and generating a bit stream using encoded data generated in the encoding of the first frequency sub-band, the envelope of the second frequency sub-band, the determined codebook codevector index, and the information indicating that the similar codebook does not exist.

4. The method of claim 3, wherein the first frequency sub-band is a low frequency sub-band.

5. The method of claim 3, wherein the high frequency band is a non-uniform band which takes hearing characteristics into consideration.

6. The method of claim 5, wherein the non-uniform band is a bark band.

7. The method of claim 3, wherein the codebooks are generated using overlapped spectra.

8. The method of claim 3, wherein the similarity is determined using a Euclidian distance or a correlation between the codebook codevectors.

9. The method of claim 3, further comprising:

generating the audio signal in a frequency domain by converting an audio signal in a time domain to the audio signal in the frequency domain.

10. An apparatus to encode a low bit-rate audio signal, the apparatus comprising:

a low frequency quantizing/encoding unit which quantizes and encodes a plurality of first frequency sub-bands in a low frequency region of a full-band audio signal having a plurality of frequency sub-bands;

a codebook generating unit which generates a codebook of codevectors using one or more of the plurality of first frequency sub-bands of the low frequency region of the full-band audio signal to vector quantize at least one high frequency sub-band or to encode at least one high frequency sub-band by perceptual noise substitution;

an envelope quantizing/encoding unit which detects an envelope of at least one second frequency sub-band in a high frequency region of the full-band audio signal higher than the highest low frequency sub-band and quantizes and encodes the detected envelope of the second frequency sub-band;

a codebook index acquiring unit which selects a codevector in the first frequency sub-band codebook most similar to the second frequency sub-band to be encoded from among the generated codebook's codevectors and determines a codebook codevector index to define a fine structure of the first frequency sub-band to help encode the structure of the similar second frequency sub-band; and a bit stream generating unit which generates a bit stream using encoded data which are generated by the low frequency quantizing/encoding unit, and the envelope quantizing/encoding unit and the determined codebook codevector index.

11. The apparatus of claim 10, wherein the low frequency quantizing/encoding unit quantizes and encodes using one of an MPEG1 layer 3 coding (mp3) and an MPEG-2/4 advanced audio coding (AAC).

12. An apparatus to encode a low bit-rate audio signal, the apparatus comprising:

a low frequency quantizing/encoding unit which quantizes and encodes a plurality of first frequency sub-bands in a low frequency region of a full-band audio signal having a plurality of frequency sub-bands;

a codebook generating unit which generates a codebook of codevectors using one or more of the plurality of first frequency sub-bands of the low frequency region of the full-band audio signal to vector quantize at least one high frequency sub-band or to encode at least one high frequency sub-band by perceptual noise substitution;

an envelope quantizing/encoding unit which detects an envelope of at least one second frequency sub-band of a high frequency region of the full-band audio signal higher than the highest low frequency sub-band and quantizes and encodes the detected envelope of the second frequency sub-band;

a similarity checking unit which checks whether a codevector of the codebook having at least a predetermined similarity exists among the generated codevectors of the codebook with respect to a high frequency band to be encoded;

a codebook existence information/index encoding unit which selects a similar codevector from the codebook, determines a codebook codevector index which defines a fine structure of the first frequency sub-band if the similar codevector in the codebook exists, and encodes the determined codebook codevector index and information indicating that the similar codevector exists;

a codebook existence information encoding unit which encodes information indicating that a similar codevector in the codebook does not exist if a similar codevector in the codebook does not exist; and a bitstream generating unit which generates a bit stream using encoded data which are generated by the low frequency quantizing/encoding unit, the codebook existence information/index encoding unit, and the codebook existence information encoding unit.

13. The apparatus of claim 12, wherein the first frequency sub-band is a low frequency sub-band.

14. The apparatus of claim 12, wherein the first frequency sub-band is a non-uniform band which takes hearing characteristics into consideration.

15. The apparatus of claim 14, wherein the non-uniform band is a bark band.

16. The apparatus of claim 12, wherein the codebooks are generated using overlapped spectra.

17. The apparatus of claim 12, wherein the similarity is determined using a Euclidian distance or a correlation between the codebooks.

18. The apparatus of claim 12, further comprising:

a T/F converting unit which converts an audio signal in a time domain into the audio signal in a frequency domain.

19. An encoding apparatus, comprising:

a first quantizing/encoding unit to quantize a plurality of first frequency sub-bands of a full spectrum audio signal having a plurality of frequency sub-bands and to encode the quantized first frequency sub-bands;

a second quantizing/encoding unit to quantize one or more envelopes of at least one second frequency sub-band of the full spectrum audio signal and to encode the quantized one or more envelopes;

a codebook unit to generate a codebook of one or more codevectors from the first frequency sub-bands to vector quantize the at least one second frequency sub-band of the plurality of frequency sub-bands or to encode the at least one second frequency sub-band by perceptual noise substitution, to determine whether a similar codevector in the codebook exists for the second frequency sub-band, and to encode codevector existence information to indicate similarities between the second frequency sub-bands and the codevectors in the codebook; and a bit stream unit to generate a bitstream including the encoded first frequency sub-band, the encoded envelopes of the at least one second frequency sub-band, and the encoded codevector existence information.

20. The encoding apparatus of claim 19, wherein the second quantizing/encoding unit encodes the envelopes of the second frequency sub-band using the vector quantization when the corresponding second bands in the second frequency sub-band are determined to be similar to ones of the codevectors, and encodes the envelopes of the second frequency sub-band using the perceptual noise substitution when the corresponding second bands in the second frequency sub-band are determined not to be similar to any of the codebooks.

21. A method of decoding a low bit-rate audio signal, the method comprising:

dividing a bit stream into a plurality of first frequency sub-bands of a full-band audio signal having a plurality of frequency sub-bands, and at least one second frequency sub-band other than the first frequency sub-band of the full-band audio signal;

decoding and inversely quantizing the first frequency sub-bands of the full-band audio signal;

restoring codebook codevector index information which defines a fine structure of the first frequency sub-band to help encode the structure of the similar second frequency sub-band and envelope information about the second frequency sub-band;

generating a codebook of codevectors using the inversely quantized first frequency sub-band to inversely vector quantize the at least one second frequency sub-band or to decode the at least one second frequency sub-band by perceptual noise substitution; and restoring the second frequency sub-band using the restored codebook codevector index information and the restored envelope information about the second frequency sub-band.

22. The method of claim 21, wherein the decoding and inverse quantizing of the first frequency sub-band is one of an MPEG1 layer 3 decoding (mp3) and an MPEG-2/4 advanced audio decoding (AAC).

23. A method of decoding a low bit-rate audio signal, the method comprising:

dividing a bit stream into a plurality of first frequency sub-bands of a full-band audio signal having a plurality of frequency sub-bands and at least one second frequency sub-band other than the first frequency sub-band of the full-band audio signal;

decoding and inversely quantizing the first frequency sub-bands of the full-band audio signal;

decoding information as to whether a similar codevector in a codebook exists;

if a similar codevector in the codebook exists, restoring codebook codevector index information that defines a fine structure of the first frequency sub-band and envelope information about the second frequency sub-band to help decode the structure of the similar second frequency sub-band;

generating a codebook of codevectors to inversely vector quantize at least one second frequency sub-band or to decode the at least one second frequency sub-band by perceptual noise substitution using the first frequency sub-bands which are decoded and inversely quantized and restoring the at least one second frequency sub-band using the restored codebook index information that defines a fine structure of the first frequency sub-band and the restored envelope information about the second frequency sub-band; and if a similar codebook does not exist, restoring the envelope information and restoring the second frequency sub-band using a signal of a previous band and the restored envelope information.

24. The method of claim 23, wherein the first frequency sub-band is a low frequency sub-band.

25. The method of claim 23, wherein the previous band is a non-uniform band which takes hearing characteristics into consideration.

26. The method of claim 25, wherein the non-uniform band is a bark band.

27. The method of claim 23, wherein the codebooks are generated using overlapped spectra.

28. The method of claim 23, wherein the similarity is determined using a Euclidian distance or a correlation between the codebooks.

29. The method of claim 23, further comprising:

generating the audio signal by inversely converting an audio signal in a frequency domain into an audio signal in a time domain.

30. An apparatus to decode a low bit-rate audio signal, the apparatus comprising:

a bit stream dividing unit which divides a bit stream into a plurality of first frequency sub-bands of a full-band audio signal having a plurality of frequency sub-bands and at least one second frequency sub-band other than the first frequency sub-bands of the full-band audio signal;

a low frequency restoring unit which decodes and inversely quantizes the first frequency sub-bands of the full-band audio signal;

a high frequency index/envelope restoring unit which restores codebook codevector index information which defines a fine structure of the first frequency sub-band and envelope information about the second frequency sub-band to help restore the structure of the similar second frequency sub-band;

a codebook generating unit which generates a codebook of codevectors using the first frequency sub-band inversely quantized in the low frequency restoring unit to inversely vector quantize at least one second frequency sub-band or to decode at least one second frequency sub-band by perceptual noise substitution; and a high frequency restoring unit which restores the second frequency sub-band using the restored codebook codevector index information that defines a fine structure of the second frequency sub-band and the restored envelope information about the other frequency sub-band.

31. The apparatus of claim 30, wherein the quantizing and decoding and inverse quantization is one of an MPEG1 layer 3 decoding (mp3) and an MPEG-2/4 advanced audio decoding (AAC).

32. An apparatus to decode a low bit-rate audio signal, the apparatus comprising:

a bit stream dividing unit which divides a bit stream into a plurality of first frequency sub-bands of a full-band audio signal having a plurality of frequency sub-bands and at least one second frequency sub-band other than the first frequency sub-bands of the full-band audio signal;

a low frequency restoring unit which decodes and inversely quantizes the first frequency sub-bands of the full-band audio signal;

a codebook existence information restoring unit which decodes information as to whether a similar codevector of a codebook exists to inversely vector quantize at least one second frequency sub-band or to decode at least one second frequency sub-band by perceptual noise substitution;

an index/envelope restoring unit which, if the similar codevector of the codebook exists, restores codebook codevector index information that defines a fine structure of the first frequency sub-band and envelope information about the second frequency sub-band to restore the similar second frequency sub-band;

a first high frequency restoring unit which generates a codebook of codevectors using the first frequency sub-band which is decoded and inversely quantizes and restores the second frequency sub-band using the restored codebook index information and the restored envelope information about the second frequency sub-band; and a second high frequency restoring unit which, if a similar codevector does not exist, restores the envelope information and restores the second frequency sub-band using a signal of a previous band and the restored envelope information.

33. The apparatus of claim 32, wherein the first frequency sub-band is a low frequency sub-band.

34. The apparatus of claim 32, wherein the previous band is a non-uniform band which takes hearing characteristics into consideration.

35. The apparatus of claim 34, wherein the non-uniform band is a bark band.

36. The apparatus of claim 32, wherein the codebooks are generated using overlapped spectra.

37. The apparatus of claim 32, wherein the similarity is determined using a Euclidian distance or a correlation between the codebooks.

38. The apparatus of claim 32, further comprising:

an F/T converting unit which inversely converts the audio signal from an audio signal in a frequency domain into an audio signal in a time domain.

39. A non-transitory computer-readable medium having a computer executable program for a method of encoding a low bit-rate audio signal, the method comprising:

quantizing and encoding a plurality of first frequency sub-bands of a full-band audio signal having a plurality of frequency sub-bands in a low frequency region of the full-band audio signal;

generating a codebook of codevectors using the first frequency sub-bands in the low frequency region to vector quantize at least one high frequency sub-band or to encode at least one high frequency sub-band by perceptual noise substitution;

detecting an envelope of at least one second frequency sub-band of the full-band audio signal other than the first frequency sub-bands in a high frequency region and quantizing and encoding the envelope;

selecting a codevector in the first frequency sub-band codebook that is most similar to the second frequency sub-band to be encoded from the codebook's codevectors and determining a codebook codevector index which defines a fine structure of the first frequency sub-band to help encode the structure of the similar second frequency sub-band; and generating a bit stream using encoded data generated in the encoding of the first frequency sub-band, the envelope, and the determined codebook codevector index.

40. A non-transitory computer-readable medium having a computer executable program for a method of encoding a low bit-rate audio signal, the method comprising:

quantizing and encoding a plurality of first frequency sub-bands in a low frequency region of the full-band audio signal having a plurality of frequency sub-bands;

generating a codebook of codevectors using the first frequency sub-bands in the low frequency region to vector quantize at least one high frequency sub-band or to encode at least one high frequency sub-band by perceptual noise substitution;

detecting an envelope of at least one second frequency sub-bands of the full-band audio signal other than the first frequency sub-bands in a high-frequency region and quantizing and encoding the detected envelope of the second frequency sub-band;

checking whether a codevector of a codebook having at least a predetermined similarity exists among the generated codevectors of the codebook with respect to the first frequency sub-band to help a similar second frequency sub-band to be encoded;

if the similar codevector of the codebook exists, selecting the similar codevector of the codebook, determining a codebook codevector index which defines a fine structure of the first frequency sub-band to help encode the similar second frequency sub-band, and encoding the determined codebook index and information indicating that the similar codebook exists;

if a similar codevector of the codebook does not exist, encoding information indicating that a similar codevector of the codebook does not exist; and generating a bit stream using encoded data generated in the encoding of the first frequency sub-band, the envelope of the second frequency sub-band, the determined codebook codevector index, and the information indicating that the similar codebook codevector does not exist.

41. A non-transitory computer-readable medium having a computer executable program for a method of decoding a low bit-rate audio signal, the method comprising:

dividing a bit stream into a plurality of first frequency sub-bands of a full-band audio signal having a plurality of frequency sub-bands and at least one second frequency sub-band higher than the highest first frequency sub-band of the full-band audio signal;

decoding and inversely quantizing the first frequency sub-band of the full-band audio signal;

restoring codebook codevector index information that defines a fine structure of the first frequency sub-band and envelope information about the second frequency sub-band to help restore the structure of the similar second frequency sub-band;

generating a codebook of codevectors to inversely vector quantize at least one second frequency sub-band or to decode at least one second frequency sub-band by perceptual noise substitution using the inversely quantized first frequency sub-band; and restoring the second frequency sub-band using the restored codebook codevector index information and the restored envelope information about the second frequency sub-band.

42. A non-transitory computer-readable medium having a computer executable program for a method of decoding a low bit-rate audio signal, the method comprising:

dividing a bit stream into a plurality of first frequency sub-bands of a full-band audio signal having a plurality of frequency sub-bands and at least one second frequency sub-band higher than the highest first frequency sub-band of the full-band audio signal;

decoding and inversely quantizing the first frequency sub-bands of the full-band audio signal;

decoding information as to whether a similar codevector of a codebook exists;

if a similar codevector of the codebook exists, restoring codebook codevector index information that defines the fine structure of the first frequency sub-band and envelope information about the second frequency sub-band to help restore the structure of the similar second frequency sub-band;

generating a codebook of codevectors to inversely vector quantize at least one second frequency sub-band or to decode at least one second frequency sub-band by perceptual noise substitution using the first frequency sub-bands which are decoded and inversely quantized and restoring the second frequency sub-band using the restored codebook codevector index information and the restored envelope information about the second frequency sub-band; and if a similar codevector in the codebook does not exist, restoring the envelope information and restoring the second frequency sub-band using a signal of a previous band and the restored envelope information.

43. A method of encoding a full-band audio signal, the method comprising:

encoding a plurality of first frequency sub-bands of the full-band audio signal having a plurality of frequency sub-bands;

generating a codebook of codevectors to vector quantize at least one high frequency sub-band or to encode at least one high frequency sub-band by perceptual noise substitution using the first frequency sub-bands;

determining an envelope of at least one second frequency sub-band of the full-band audio signal which is different than the first frequency sub-band and encoding the envelope;

selecting one of the generated codevectors of the codebook if it has a predetermined similarity to the second frequency sub-band; and encoding a bit stream with the encoded first frequency sub-bands, the encoded envelope, and one of an indication that a codevector of the codebook was selected with an index of the selected codebook which defines a fine structure of the first frequency sub-band to help encode the structure of the similar second frequency sub-band and an indication that a codebook was not selected.

44. A method of decoding an audio signal, the method comprising:

dividing a bit stream into a plurality of first frequency sub-bands of a full-band audio signal having a plurality of frequency sub-bands and at least one second frequency sub-band having envelope information of the full-band audio signal;

decoding the first frequency sub-band and generating codevectors of a codebook to inversely quantize at least one high frequency sub-band or to decode at least one high frequency sub-band by perceptual noise substitution using the decoded first frequency sub-band;

decoding codebook information which defines a fine structure of the first frequency sub-band indicating whether a codevector of the generated codebook has a similarity to the first frequency sub-band to help decode the structure of the similar second frequency sub-band;

restoring the second frequency sub-band based on the codebook information using one of a generated codevectors of the codebook with the envelope information and a signal of a previous band with the envelope information.

* * * * *